US008628388B2

(12) United States Patent
Codling

(10) Patent No.: US 8,628,388 B2
(45) Date of Patent: Jan. 14, 2014

(54) LABORATORY CONTAINMENT SYSTEM

(75) Inventor: Sean Patrick Codling, Portsmouth (GB)

(73) Assignee: A1 Envirosciences Limited, Bedfordshire (GB)

( * ) Notice: Subject to any disclaimer, the term of this patent is extended or adjusted under 35 U.S.C. 154(b) by 1180 days.

(21) Appl. No.: 12/392,626

(22) Filed: Feb. 25, 2009

(65) Prior Publication Data

US 2009/0215376 A1 Aug. 27, 2009

(30) Foreign Application Priority Data

Feb. 25, 2008 (GB) ..... 0803379.7

(51) Int. Cl.
*B08B 15/00* (2006.01)
*B08B 15/02* (2006.01)

(52) U.S. Cl.
CPC ..... *B08B 15/023* (2013.01)
USPC ..... 454/57; 454/56; 454/61

(58) Field of Classification Search
USPC ..... 454/56, 57, 61
See application file for complete search history.

(56) References Cited

U.S. PATENT DOCUMENTS

| | | | | | |
|---|---|---|---|---|---|
| 2,085,297 | A * | 6/1937 | Deibel | 422/567 |
| 3,022,718 | A | 2/1962 | Thompson | |
| 3,041,957 | A * | 7/1962 | Liptay | 454/56 |
| 3,049,069 | A * | 8/1962 | Whiston et al. | 454/56 |
| 3,358,579 | A | 12/1967 | Hauville | |
| 3,415,180 | A | 12/1968 | Arhex | |
| 3,874,754 | A * | 4/1975 | Saunders et al. | 312/209 |
| 3,941,040 | A * | 3/1976 | Carlson | 454/56 |
| 4,062,274 | A * | 12/1977 | Knab | 454/65 |
| 4,197,646 | A * | 4/1980 | Morrison | 433/97 |
| 4,632,022 | A * | 12/1986 | Baitinger et al. | 454/56 |
| 4,811,724 | A * | 3/1989 | Aalto et al. | 126/299 D |
| 4,996,910 | A * | 3/1991 | Howorth | 454/57 |
| 5,322,470 | A * | 6/1994 | Vartiainen et al. | 454/49 |
| 5,407,389 | A * | 4/1995 | Poblete et al. | 454/56 |
| 5,685,771 | A * | 11/1997 | Kleppen | 454/56 |
| 6,461,233 | B1 * | 10/2002 | Gilkison et al. | 454/57 |
| 6,620,038 | B1 * | 9/2003 | Kikuchi et al. | 454/66 |
| 6,659,857 | B2 * | 12/2003 | Ryan et al. | 454/56 |
| 2003/0027515 | A1 | 2/2003 | Ryan et al. | |

FOREIGN PATENT DOCUMENTS

| | | | |
|---|---|---|---|
| GB | 1146263 | | 3/1969 |
| JP | 2003004276 | A * | 1/2003 |

* cited by examiner

*Primary Examiner* — Steven B McAllister
*Assistant Examiner* — Frances H Kamps
(74) *Attorney, Agent, or Firm* — Heslin Rothenberg Farley & Mesiti P.C.

(57) ABSTRACT

A laboratory bench-top fume hood comprises an enclosure containing a working chamber with a frontal opening for manual access and airflow into the chamber. A plenum behind the working chamber is connectable to an air extraction system. An apertured, curved baffle plate separates the working chamber from the plenum, and is convex from the plenum side, improving airflow and increasing usable volume of the working chamber. Slots in the baffle plate may be fitted with guide vanes extending into the plenum. A slot adjacent a roof of the working chamber is effective for creating evenly-distributed air flows. The roof may be curved to encourage an airflow to follow the roof profile to the baffle plate. Sidewalls of the working chamber may bow outwardly but converge towards the opening. The baffle plate may comprise a set of separately dismountable panels, to aid cleaning and provide access to the plenum.

13 Claims, 4 Drawing Sheets

LABORATORY CONTAINMENT SYSTEM

BACKGROUND ART

The present invention relates to a containment system for safe performance of laboratory procedures and the like. More particularly but not exclusively, it relates to a bench-top enclosure provided with an air extraction system to protect a user from hazardous materials therein.

In the area of pharmaceutical research and development, the drugs, reagents and intermediate products employed in the laboratory are becoming increasingly potent and potentially hazardous. Not only do chemical reactions need to be carried out in fume hoods or the like, but instrumentation increasingly often needs to be enclosed to prevent analysts and other workers coming into contact with hazardous materials while operating the instrumentation.

A common solution to this problem is the use of bench-mounted containment systems to hold anything from balances to advanced analytical apparatus, thus protecting the analyst or other worker. Conventionally, instrument enclosures for such equipment are provided with air extraction arrangements. Air is drawn in through a frontal opening of the enclosure and exhausted, with treatment where necessary, through the rear of the enclosure. Ideally, a smooth laminar air flow from front to rear of the enclosure is required. This prevents dust and/or vapours escaping through the frontal opening, particularly when a user stands by the opening to manipulate equipment within the enclosure; a laminar flow with minimum turbulence reduces the risk of fine powders becoming spilt or entrained in the airflow. Turbulent flow can also interfere with the operation of sensitive equipment, such as analytical balances. It is customary to draw air through a baffle into a plenum chamber mounted at the rear of the enclosure, prior to extraction into an exhaust system, in order to help to control and direct the air flow. However, existing systems of this type have drawbacks.

Such baffle and plenum arrangements occupy significant volumes within the enclosure. For example, a standard exhaust port fitting may be 100 to 150 mm in diameter, so a plenum in excess of 150 mm deep is used. A typical laboratory bench is 750 mm in depth. As a result, the plenum and baffle significantly affect the usable volume within the enclosure and the "footprint" of the enclosure on the bench-top, where space is frequently at a premium. It would thus be beneficial to save space on air extraction arrangements.

It would also be beneficial if such enclosures were easier to clean, either routinely or following a contamination episode.

It is hence an object of the present invention to provide an enclosure adapted to hold laboratory equipment and hazardous materials that obviates the above problems and provides some or all of the benefits referred to above.

SUMMARY OF THE INVENTION

According to a first aspect of the present invention, there is provided an enclosure mountable on a laboratory bench or the like, comprising chamber means adapted to hold at least one item of scientific apparatus and having opening means adapted for manual access to said apparatus, plenum means operatively connectable to air extraction means, and apertured baffle means extending between the chamber means and the plenum means, wherein the baffle means extends convexly into the plenum means.

Preferably, the baffle means is convexly curved towards the plenum means.

Advantageously, the baffle means is curved in two planes.

The baffle means may be domed into the plenum means.

The baffle means may be substantially part-spheroidal, hyperboloidal or paraboloidal.

According to a second aspect of the present invention, there is provided an enclosure mountable on a laboratory bench or the like, comprising chamber means adapted to hold at least one item of scientific apparatus and having opening means adapted for manual access to said apparatus, plenum means operatively connectable to air extraction means, and apertured baffle means extending between the chamber means and the plenum means, wherein at least some of the aperture means of the baffle means are provided with means to guide a direction of an airflow therethrough.

Said guidance means may comprise vane means.

Said vane means may extend from rim means of the aperture means into the plenum means.

According to a third aspect of the present invention, there is provided an enclosure mountable to a laboratory bench or the like, comprising chamber means adapted to hold at least one item of scientific apparatus and having opening means adapted for manual access to said apparatus, plenum means operatively connectable to air extraction means, and apertured baffle means extending between the chamber means and the plenum means, wherein said apertured baffle means comprises elongate aperture means extending adjacent roof means of the chamber means.

Preferably, said elongate aperture means extends immediately adjacent said roof means.

According to a fourth aspect of the present invention, there is provided an enclosure mountable to a laboratory bench or the like, comprising chamber means adapted to hold at least one item of scientific apparatus and having opening means adapted for manual access to said apparatus, plenum means operatively connectable to air extraction means, and apertured baffle means extending between the chamber means and the plenum means, wherein the chamber means is provided with arched roof means.

Preferably, said roof means is so profiled as to direct an airflow adjacent an internal face thereof towards aperture means of the baffle means.

Advantageously, said roof means comprises a plurality of conjoined generally planar panel means.

Alternatively, said roof means comprises a single curved roof panel.

According to a fifth aspect of the present invention, there is provided an enclosure mountable on a laboratory bench or the like, comprising chamber means adapted to hold one or more items of scientific apparatus and having opening means adapted for manual access to said apparatus, plenum means operatively connectable to air extraction means, and apertured baffle means extending between the chamber means and the plenum means, wherein the chamber means is provided with generally vertical side wall means bowed outwardly therefrom.

Preferably, the chamber means comprises opposite side wall means extending convergently towards the opening means.

Advantageously, the wall means each comprise a plurality of conjoined generally vertically extending, generally planar panel means.

According to a sixth aspect of the present invention, there is provided an enclosure mountable to a laboratory bench or the like, comprising chamber means adapted to hold one or more items of scientific apparatus and having opening means adapted for manual access to said apparatus, plenum means operatively connectable to air extraction means, and apertured baffle means extending between the chamber means and the plenum means, wherein the baffle means comprises a plurality of connected or connectable sections.

According to a seventh embodiment of the present invention, there is provided an enclosure mountable to a laboratory bench or the like and adapted to hold at least one item of scientific apparatus, embodying two or more of the first to sixth aspects described above.

BRIEF SUMMARY OF THE DRAWING FIGURES

The present invention will now be more particularly described by way of example and with reference to the accompanying drawings, in which.

DETAILED DESCRIPTION

Figure 1:
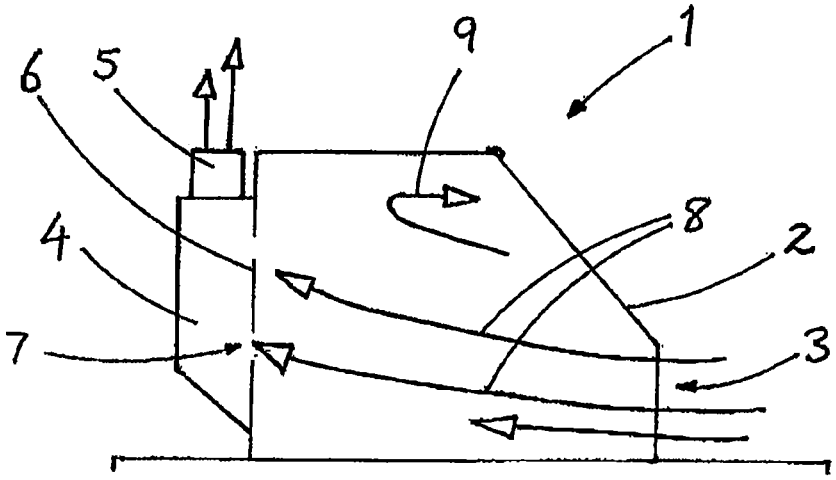
Fig 1 PRIOR ART
FIG. 1 is a schematic cross-sectional side elevation of a bench-mountable enclosure of known form.
Figure 2:
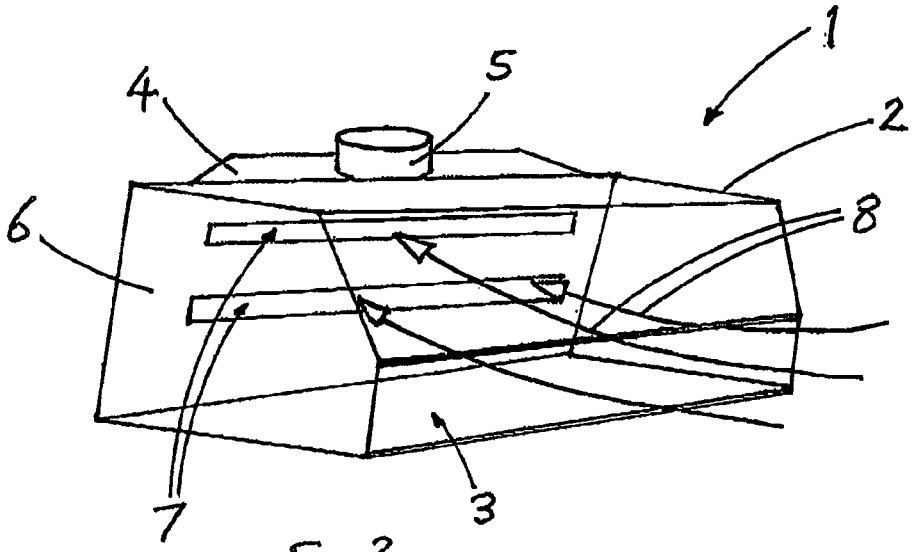
Fig 2 PRIOR ART
FIG. 2 is a schematic perspective view of the enclosure shown in FIG. 1.

Referring now to the Figures and to FIGS. 1 and 2 in particular, a bench-top enclosure 1 of conventional form comprises a working chamber 2 made up of a plurality of flat panels, at least some of which comprise a clear plastics material such as polycarbonate. A low frontal opening 3 allows a user to manipulate equipment and samples within the working chamber 2, and also allows air to be drawn into the chamber 2.

A plenum chamber 4 is mounted at a rear of the enclosure 1, and is connected by means of an exhaust port 5 to an air extraction system (not shown). The plenum chamber 4 is separated from the working chamber 2 by a baffle plate 6, provided, as shown in FIG. 2, with a number of elongate horizontally-extending slots 7 through which air may be drawn into the plenum chamber 4.

When the extraction system is operated, air is thus drawn through the frontal opening 3, through the working chamber 2, through the slots 7 in the baffle 6 and into the plenum chamber 4, from which it is extracted through the exhaust port 5. The airflows represented by arrows 8 thus prevent hazardous fumes, dusts or vapours escaping towards the user, instead collecting them to be handled by filtration arrangements in the air extraction system.

There are drawbacks in this conventional arrangement, however. For example, the airflows 8 can be made uniform in ideal conditions with an empty working chamber 2, but may be disrupted when large items of equipment are present therein. There is a risk of a circulating flow 9 forming in regions of the working chamber 2 remote from the opening 3 and the slots 7. This might lead to instability in the main airflows 8 when they interact with the circulating flow 9, or even turbulence. Turbulence could cause undesirable entrainment of fine powders, and might interfere with some sensitive equipment such as analytical balances. Even relatively small air pressure variations within the working chamber 2 could be undesirable.

As discussed above, the diameter of a standard exhaust port 5 usually constrains the plenum 4 chamber to be at least 150 mm deep, front to rear. With a typical laboratory bench being around 750 mm deep, this can leave the working chamber 2 inconveniently cramped if multiple or large items of equipment are located therein.

The conventional form of baffle 6 shown comprises a single sheet of metal with the slots 7 cut out of it, effectively forming a fixed, apertured rear wall of the working chamber 2. Should one wish to clean or decontaminate the enclosure, this arrangement may be inconvenient.

Figure 3:
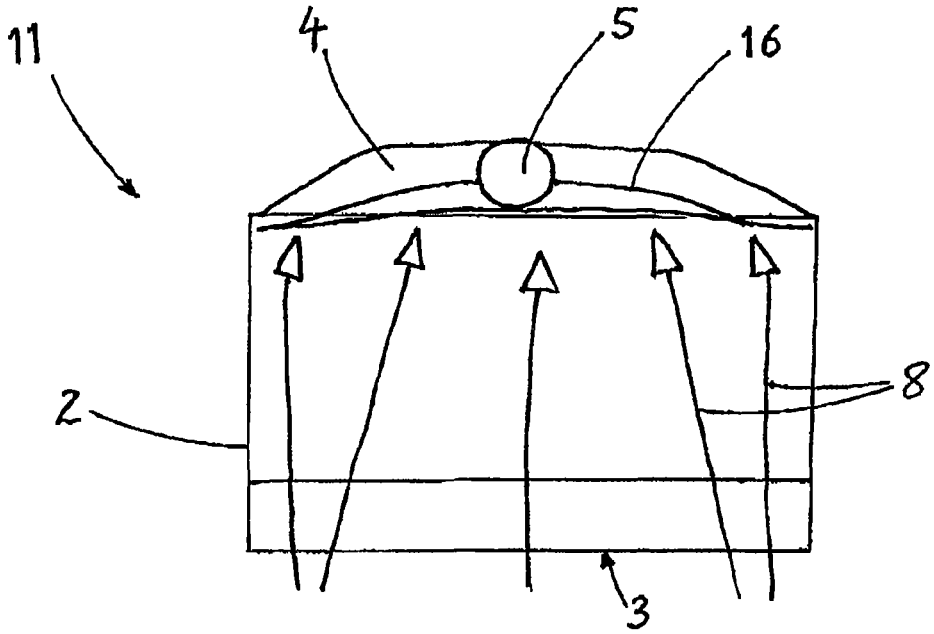
FIG. 3 is a schematic plan view of a first bench-mountable enclosure embodying the present invention.
Figure 4:
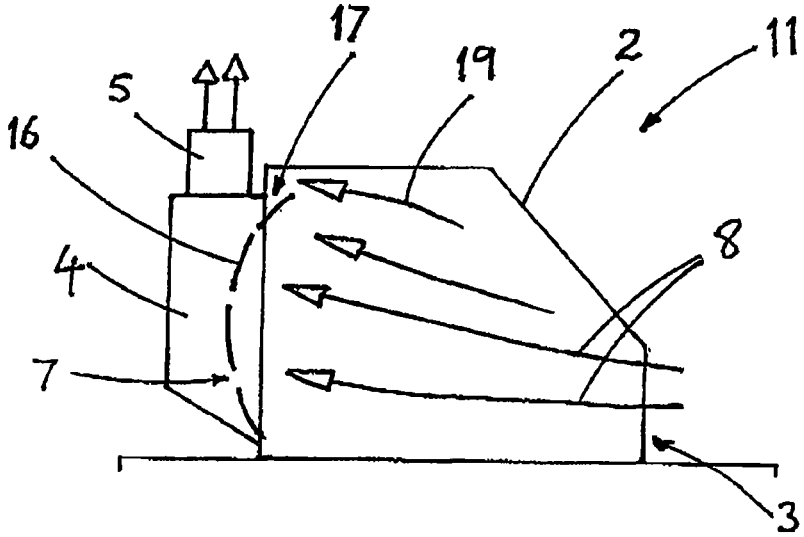
FIG. 4 is a schematic cross-sectional side elevation of the enclosure shown in FIG. 3.

FIGS. 3 and 4 show a first bench-mountable enclosure 11 embodying the present invention. As for the conventional enclosure 1, the first enclosure 11 comprises a working chamber 2 made up of flat panels, with a low frontal opening 3 for manual access and for the ingress of air. A plenum chamber 4 mounted at the rear of the working chamber 2 is connected by an exhaust port 5 to an air extraction system of conventional form.

However, in place of the flat baffle plat 6 of conventional enclosures 1, a curved baffle plate 16 separates the working chamber 2 from the plenum chamber 4. The curved baffle 16 is concave from the viewpoint of the working chamber 2, thus extending convexly into the plenum chamber 4. The curved baffle plate 16 is, like the flat one 6, provided with a plurality of elongate horizontally-extending slots 7 through which air is drawn into the plenum chamber 4.

Ideally, the curved baffle 16 is curved in both a horizontal and a vertical sense (i.e. it has a dished profile), as shown, but significant benefits still arise where the curved baffle 16 is curved in only one sense (i.e. part-cylindrical), and this version may be easier to construct. Also, instead of the curved baffle 16 being curved across its entire surface, as shown, substantially equivalent benefits would probably arise where the curved baffle 16 comprises a series of substantially flat panels disposed in a generally curved overall configuration. The slots 7 would then conveniently be defined between neighbouring panels. (NB: the curved baffle 16 may be made from metal or plastics material, formed or moulded as desired).

The curved baffle 16 projecting into the plenum chamber 4 has no adverse effect on its operation and may even improve airflow therein, while allowing sufficient depth at an upper end of the plenum chamber 4 to fit a conventionally sized exhaust port 5. The volume added to the working chamber 2 is however significant. For example, much scientific equipment is provided with electrical connections and other services that extend from a rear, in use, of their casing. The concavity formed by the curved baffle 16 allows the equipment to be mounted further back in the working chamber 2 without fouling the baffle 6, 16. Another benefit would arise where the added volume is used to facilitate cooling of equipment in the enclosure; in the conventional enclosure 1, it may be necessary to jam larger equipment up against the flat baffle 6 to fit it in, leaving little space for cooling air flows over the rear of the equipment casing.

This profile for the baffle plate 16 also appears to lead to more even, well-distributed air flow 8 from the opening 3 across the working chamber 2 to the slots 7 in the baffle plate 16. It has been found to reduce air pressure variations within the working chamber significantly.

The first enclosure 11 is provided with several further features that would also be of benefit if implemented on an otherwise conventional enclosure 1 as described above. The curved baffle plate 16 is ideally made in several sections, detachable each from the others and from a remainder of enclosure 11. These may be mounted to the structure of the plenum chamber 4, the working chamber 2, or both. It is thus possible to dismantle the baffle plate 16 for cleaning, and to allow cleaning of the plenum chamber 4. It is believed that this feature is hitherto unknown in conventional enclosures 1 with flat baffle plates 6.

This also permits the installation of baffle plates 16 of alternative configurations (different curvatures, for example, or different numbers or arrangements of slots 7), should one wish to change the airflow 8 patterns for particular purposes.

The first enclosure 11 is also provided, as shown in FIG. 4, with an elongate top aperture 17, defined between an upper edge of the baffle plate 16 and an edge of the roof of the plenum chamber 4. This top aperture 17 encourages the formation of an upper air flow 19 adjacent a roof of the working chamber 2, leading to the top aperture 17. The likelihood of a stagnant volume forming near the roof of the working chamber 2, or of a recirculating flow 9 as shown in FIG. 1, is thus considerably reduced. This improves the quality of the overall airflow 8, 19 through the working chamber 2. While the top aperture 17 is straightforward to implement with the curved baffle plate 16, as shown, it should also be of benefit if a conventional enclosure 1 with a flat baffle plate 6 were also provided with a top aperture 17 at its upper edge.

The configuration of the top aperture 17 in FIG. 4 also shows another novel feature present in the first enclosure 11. It is normal for the slots 7 to be simply that, openings in a flat plate. However, it has been found to be beneficial to provide vanes or the like to guide the airflows 8, 19 through the baffle plate 16 in a preferred direction. In FIG. 4, the upper margin of the curved baffle plate 16 forms a guiding vane for the top aperture 17. Although no vanes are shown for the remaining slots 7 in the curved baffle 16, one may for example add vanes extending into the plenum chamber 4 from the upper and/or lower rim of each slot 7 so as to channel and guide the airflows 8 passing therethrough. This is believed to be another feature that has not been employed on conventional flat baffle plates 6, but which would be of similar benefit there, as well as with the curved baffle plate 16.

Even where vanes as such are not used, considerable control over airflow 8, 19 patterns can be achieved by varying the size and distribution of the slots 7.

Figure 5:
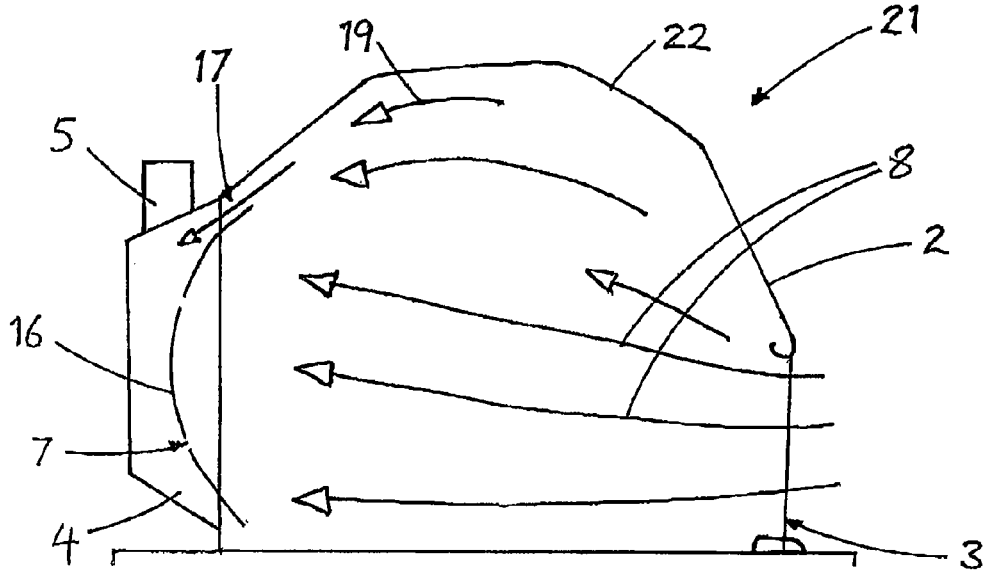
FIG. 5 is a schematic cross-sectional side elevation of a second bench-mountable enclosure embodying the present invention.

FIG. 5 shows a second bench-mountable enclosure 21 embodying the present invention, which is very similar to the first enclosure 11, above, apart from the configuration of the working chamber 2. The second enclosure 21 has an arched roof 22 to the working chamber 2, which helps to establish a smooth upper airflow 19 adjacent an interior of the roof 22. In this second enclosure 21, the arched roof 22 comprises a series of elongate substantially flat panels connected to approximate a barrel vault.

Figure 6:
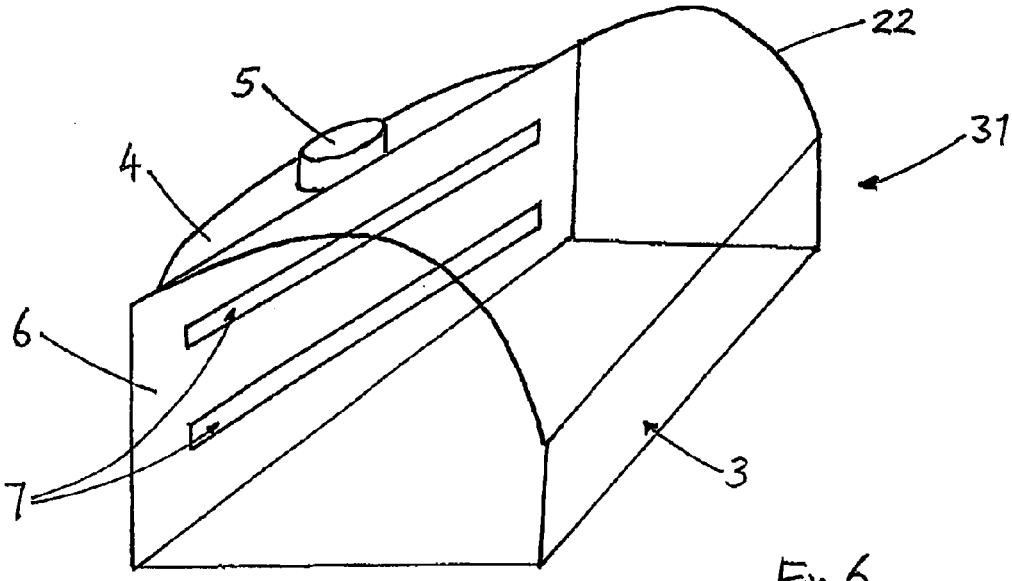
FIG. 6 is a schematic perspective view of a third bench-mountable enclosure embodying the present invention.

While the arched roof 22 is particularly useful in conjunction with the curved baffle plate 16 and the top aperture 17, it is also beneficial with a conventional flat baffle plate 6, as in a third bench-mountable enclosure 31, shown in FIG. 6. In the third enclosure 31, the arched roof 22 comprises a single vaulted moulding, rather than a series of conjoined panels as in the second enclosure 21. Either arrangement is beneficial; the choice between them may be based on ease of construction.

Figure 7:
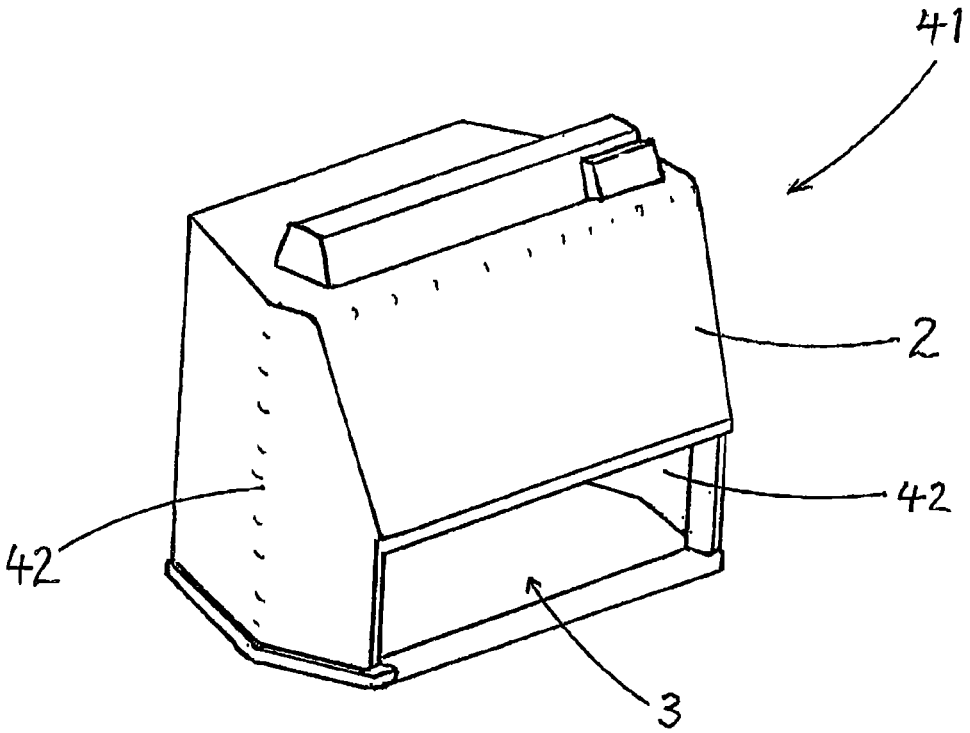
FIG. 7 is a perspective view of a fourth bench-mountable enclosure embodying the present invention.

FIG. 7 shows a fourth bench-mountable enclosure 41 embodying the present invention (the plenum chamber 4 and exhaust port 5 are omitted from FIG. 7 for simplicity). In the fourth enclosure 41, the working chamber 2 has a conventional flat roof, but its side walls 42 are bowed outwardly, either as two or more angled panels, as shown, or as a continuously curved single panel. This aids smooth airflow, and provides additional space within the working chamber 2. In the particular embodiment 41 shown, the side walls 42 are angled such that the frontal opening 3 is narrowed, relative to the equivalent conventional enclosure 1. This results in a reduced air-handling requirement, since the important criterion for safety is the air velocity inwardly through the frontal opening 3, and the lower the area of the frontal opening, the lower the volume of air that needs to be drawn therethrough to achieve the required velocity.

While the curved side walls 42 are shown in conjunction with a flat roof, they are equally usable in conjunction with an arched roof 22, at the cost of a complex joint between a curved roof and two curved walls. The curved side walls 42 are equally usable with a conventional flat baffle plate 6 or a curved baffle 16 as described above.

The features described above are each beneficial individually or in any combination of two or more in a single enclosure: They may be employed equally in an enclosure dimensioned to accommodate a single analytical balance, or in one dimensioned to enclose an entire spectrometer; in each case, they will result in improved airflow and/or improved ease of fitting equipment into the enclosure without significant increase in external dimensions.

The invention claimed is:

1. An enclosure mountable on a laboratory bench, comprising:

a working chamber comprising an opening to the front of the working chamber allowing manual access to an item of scientific apparatus received in the working chamber and allowing ingress of air, a plenum chamber mounted to a rear of the working chamber and comprising an exhaust opening connectable to an air extraction system, and an apertured baffle so extending within the enclosure as to divide the working chamber from the plenum chamber, said apertured baffle configured to allow ingress of air from the working chamber into the plenum chamber, said apertured baffle defining a plurality of apertures; wherein the apertured baffle extends convexly into the plenum chamber, and the apertured baffle is curved in both a horizontal and a vertical direction, such that the apertured baffle has a dish profile, and wherein said apertured baffle is provided with at least one guiding vane configured to guide a direction of airflow.

2. An enclosure as claimed in claim 1, wherein the apertured baffle is substantially part-spheroidal, hyperboloidal or paraboloidal.

3. An enclosure as claimed in claim 1, configured such that an elongate aperture is defined between an upper edge of said apertured baffle and an internal face of a roof of said working chamber.

4. An enclosure as claimed in claim 1, wherein the working chamber has an arched roof.

5. An enclosure as claimed in claim 4, wherein said arched roof is so profiled as to, in use, direct an airflow adjacent an internal face of the roof towards apertures of the apertured baffle.

6. An enclosure as claimed in claim 4, wherein said arched roof comprises a plurality of conjoined generally planar panels.

7. An enclosure as claimed in claim 4 wherein said arched roof comprises a single curved roof panel.

8. An enclosure as claimed in claim 1, wherein the working chamber comprises side walls bowed outwardly therefrom.

9. An enclosure as claimed in claim 8, wherein the working chamber comprises opposite side walls extending convergently towards said opening of the working chamber.

10. An enclosure as claimed in claim 8, wherein each of the side walls comprises a plurality of conjoined planar panels.

11. An enclosure as claimed in claim 1, wherein the apertured baffle comprises a plurality of releasably connectable sections.

12. An enclosure as claimed in claim 1, wherein said apertured baffle is removably installed in said enclosure.

13. An enclosure as claimed in claim 1, wherein said apertured baffle is fabricated from one of: a plastics material and a metal material.

* * * * *